US006497464B1

(12) United States Patent
Cammack et al.

(10) Patent No.: US 6,497,464 B1
(45) Date of Patent: Dec. 24, 2002

(54) ADJUSTABLE DETENT MECHANISM FOR DRAWER SLIDE

(75) Inventors: Robert J. Cammack, Fountain Valley, CA (US); Rahl F. Cabrales, Chino, CA (US); Charles A. Milligan, Hacienda Heights, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 348 days.

(21) Appl. No.: 09/602,194

(22) Filed: Jun. 22, 2000

Related U.S. Application Data

(60) Provisional application No. 60/140,431, filed on Jun. 22, 1999.

(51) Int. Cl.[7] ..... A47B 88/00
(52) U.S. Cl. ..... 312/333; 312/334.44
(58) Field of Search ..... 312/334.7, 334.8, 312/334.1, 330.1, 350, 334.4, 333, 334.44, 334.46, 334.45, 334.47, 334.11; 384/21, 22, 23, 20, 18

(56) References Cited

U.S. PATENT DOCUMENTS 4,469,384 A 9/1984 Fler et al.
5,181,782 A 1/1993 Wojcik
5,433,517 A 7/1995 Fleisch
5,439,283 A 8/1995 Schroder et al.
5,588,729 A * 12/1996 Berger ..... 312/330.1
5,757,109 A 5/1998 Parvin
6,224,177 B1 * 5/2001 Chu ..... 312/333
6,254,205 B1 * 7/2001 Wright et al. ..... 312/217

FOREIGN PATENT DOCUMENTS

WO wo 00/78183 * 12/2000

* cited by examiner

*Primary Examiner*—Janet M. Wilkens
(74) *Attorney, Agent, or Firm*—Christie, Parker & Hale, LLP

(57) ABSTRACT

A drawer slide assembly includes an adjustable detent mechanism to provide adjustable hold in force and inhibit inadvertent opening of the drawer. The drawer slide assembly comprises an outer, an intermediate and an inner slide member. Each of the members are slidably engaged with the adjacent slide member. An adjustable detent mechanism is mounted on the inner slide member adjacent the front end of the slide. The adjustable detent mechanism defines an envelope in which an adjustable arm is rotatably positioned to bear against the envelope at selected positions to adjust the shape of the envelope and thereby provide a variable detent or hold in force depending upon the position selected by the user. The force necessary to open the drawer is determined by the amount of detent or hold in force selected.

14 Claims, 8 Drawing Sheets

ADJUSTABLE DETENT MECHANISM FOR DRAWER SLIDE

CROSS-REFERENCE TO RELATED APPLICATIONS

This application claims the benefit of the filing date of U.S. Provisional Application No. 60/140,431, filed Jun. 22, 1999, the disclosure of which is incorporated herein by reference.

BACKGROUND OF THE INVENTION

The present invention relates to drawer slides and, in particular, to an adjustable mechanism which allows the detent or "hold in" force of the slide to be adjusted through a range of forces.

Telescopic drawer slides are used in many different applications. In most of the applications drawers using the slides require a detent device to hold them in the closed position. The detent device is normally incorporated into the telescopic slide. Such detent devices are usually mounted at the back of the slide and once the slide is mounted to the drawer, the detent or "hold in" feature is no longer accessible. Furthermore most prior art detent devices are characterized by a constant detent or "hold in" force and do not incorporate any mechanism for allowing or permitting the adjustability of such force.

A slide detent device prevents a drawer from opening until an external force is applied. When a user closes a drawer, the drawer/slide combination is intended to stay closed until reopened. The detent or "hold in" force is what keeps the drawer in the closed position. If a drawer slide is provided with an adjustable detent, this allows the user to change the amount of the detent or "hold in" force that must be overcame to open the drawer.

Different lower or higher detent forces are desirable depending upon the application for the drawer slide. For instance, in the case of tool boxes higher detent forces are required than for drawers that are used in desks or in normal office files. In such situations, it would be normally necessary to design one slide for a tool box and a different slide for a desk or file drawer. Moreover, some users may desire different detent forces than other users for the same application, or even different detent forces for different drawers of the same cabinet.

SUMMARY OF THE INVENTION

The present invention provides an adjustable detent device which will provide a range of "hold in" or detent forces. The detent mechanism is fixed to the inner member of the slide that is affixed to the drawer member. When the slide is in a closed position, an in-stop member on one of the other slide members will engage with the detent mechanism. The engagement of the other slide member and the detent device keeps the slide/drawer combination closed.

In the present invention the adjustable detent mechanism is a one piece molding incorporating an adjustable arm which allows the user to select different detent forces as needed depending upon the particular application for the particular drawer slide. In the present invention the detent mechanism is designed to be incorporated into the slide and be mounted adjacent to the front of the drawer so that it is accessible to the user after the slide has been installed on the drawer.

The detent mechanism according to the present invention is applicable in a variety of environments. In the kitchen and bath environment, the slide is normally utilized with a very low detent or "hold in" force. In contrast in the tool box market, the same slide may require a much higher detent or "hold in" force. Utilizing the slide and adjustable detent mechanism of the present invention enables the same slide to be used in either such application because of the adjustability of the detent device of the detent mechanism.

The advantages of the adjustable detent mechanism of the present invention are numerous. These include the fact that the mechanism can be fabricated from a one-piece plastic component. The adjustability feature comes from the incorporation of an adjustment arm into the mechanism. The arm is rotated from one position to another by utilization of conventional tools such as a screw driver, knife or the like. The adjustment arm is rotated or turned within the envelope defined by the detent mechanism to, in effect, select a fulcrum position on the detent mechanism. By changing the position of the fulcrum, the effective arm length of the detent mechanism is changed, that is, it is either lengthened or shortened. This change in the effective arm length results in a change in the detent or "hold in" force. In essence, the movement of the adjustment leg away from the head of the detent mechanism produces a lower detent or "hold in" force. Conversely, movement of the adjustment leg toward the head of the device produces a higher detent or "hold in" force.

Since the adjustment mechanism of the present invention is located at the front of the slide and is attached on the drawer side of the telescoping slide mechanism, it is easy to reach for adjustment. By provisions in the design of the detent mechanism, adjustment is made in calibrated steps by the selective placement of teeth or indentations within the envelope defined by the mechanism, thus allowing the adjustment of a pair of detent mechanisms (one is located of a drawer) to the same position thereby providing for equal detent forces on each side of the drawer.

In the preferred embodiment, the adjustment mechanism of the present invention is fabricated of plastic and this facilitates a number of other possible modifications including shaping and thickening of the adjustable detent mechanism to provide ranges of detent forces depending upon the particular application for the mechanism. The mechanism is also flexible and easily used because the adjustment of the detent force is accomplished by a screw driver, knife or even other simple hand tools. Finally, the shape of the mechanism is provided such that the leading edge thereof has a long gradual slope which provides a low force during the interval of closing the drawer. Past the point of closure, the adjustment mechanism profile is more sharply sloped at the stop in order to require a higher force during opening. during opening. It is the opening force which is adjustable by a virtue of the design of the mechanism of the present invention.

DESCRIPTION OF THE DRAWINGS

These and other aspects of the invention will be better understood by reference of the drawings wherein.

DETAILED DESCRIPTION

Figure 1:
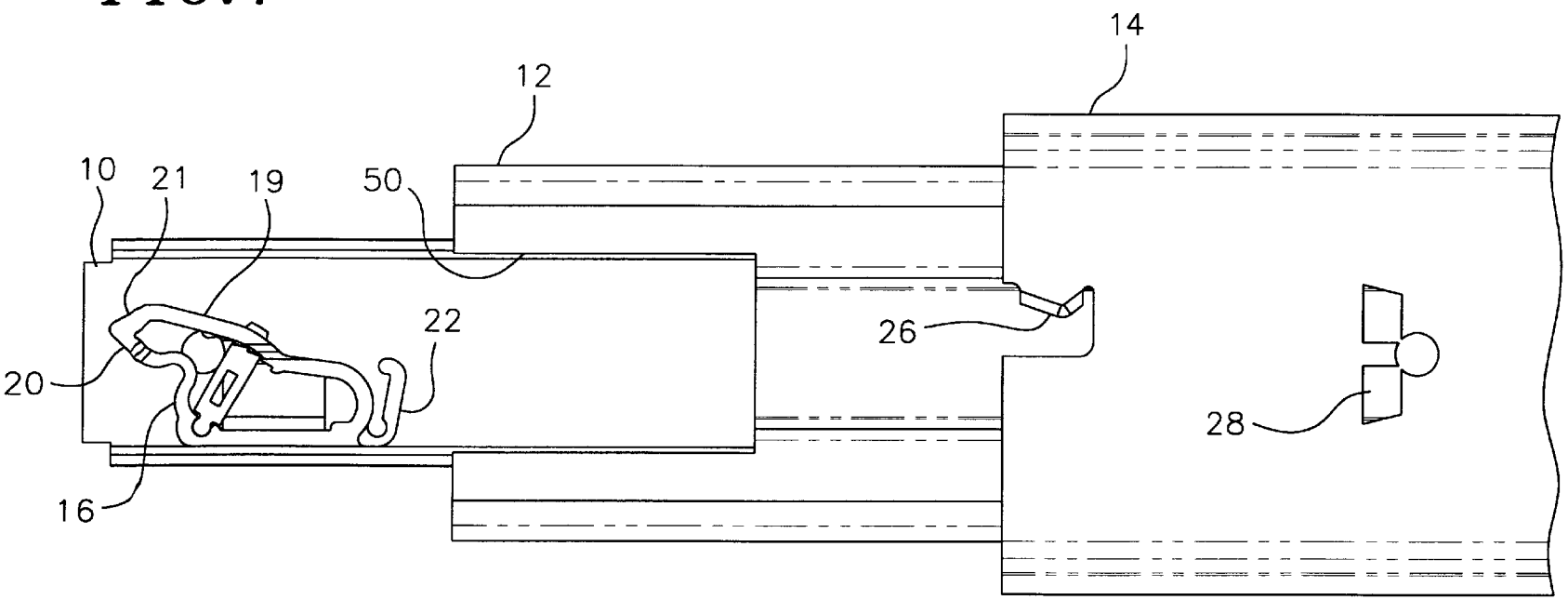
FIG. 1 is an elevation view of a three member drawer slide bearing with an adjustable detent according to the present invention.
Figure 3:
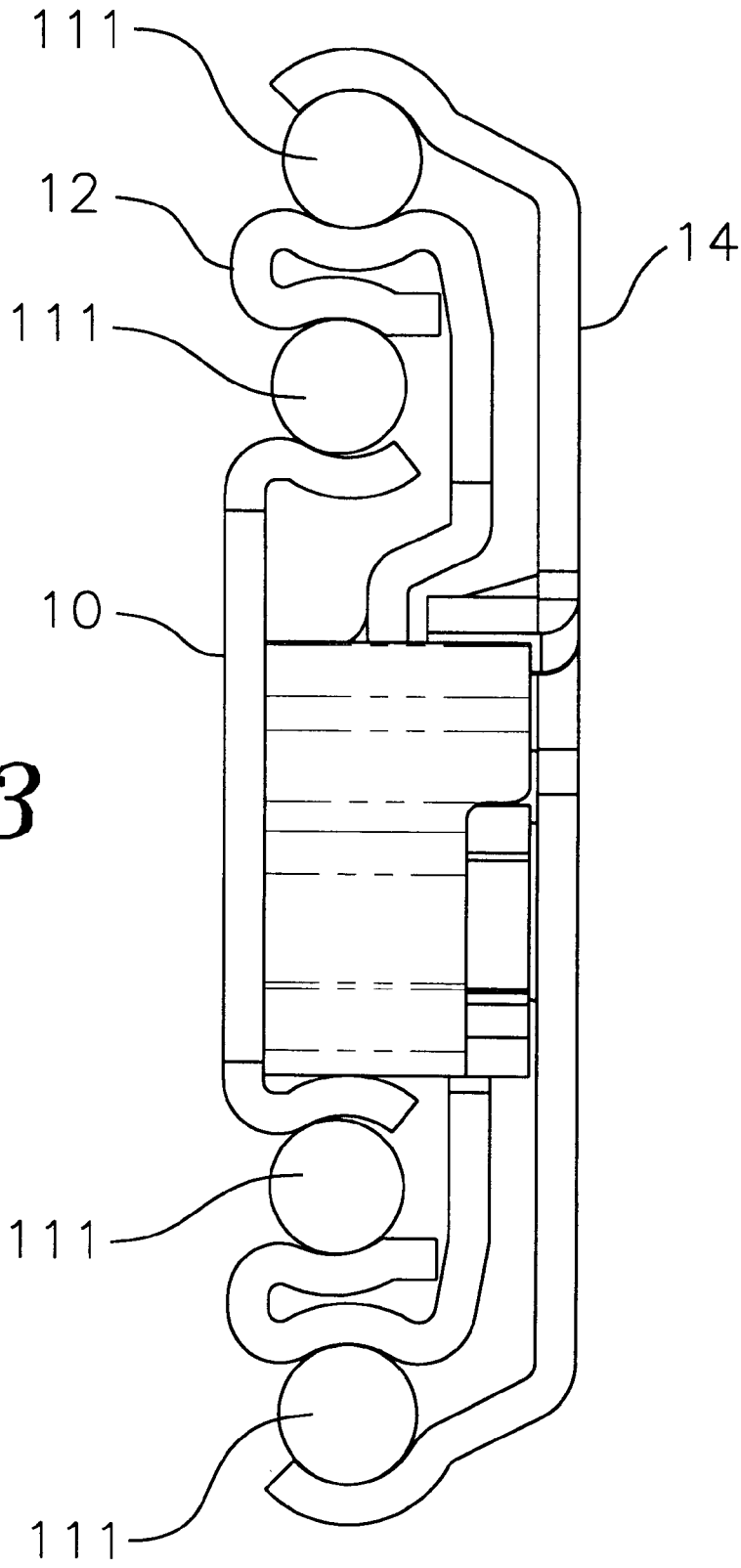
FIG. 3 is an end view of the slide of FIG. 1.

A three member drawer slide is shown in elevation in FIG. 1. The drawer slide consists of an inner slide member 10, an intermediate slide member 12 and an outer slide member 14. The inner member 10 is telescopically slideable within intermediate member 12 and intermediate member 12 is telescopically slideable within outer slide member 14. As illustrated in FIG. 3, the slide members are slidably secured to each other by means of ball bearings 111 retained in arcuate channels along the longitudinal margins of webs of the slide members. This allows adjacent members to be longitudinally slid back and forth relative to each to accomplish such tasks, for example, as opening and closing a drawer to which the drawer slide is attached.

Returning to FIG. 1, an adjustable detent mechanism 16 according to the present invention is mounted on the web on the interior of the inner slide member 10. As illustrated in FIG. 1, the detent mechanism is located adjacent the front end of the drawer slide. The location of the adjustable detent mechanism at this position enables easy access to the mechanism, for example by slightly opening the drawer, after installation of the slide. Access to the detent mechanism permits adjustment of the detent mechanism to adjust the detent force which the mechanism provides when the closed drawer is opened. In an alternative embodiment, however, the detent mechanism is located at the rear of the slide. With respect to directions front and rear refer to locations on the slide approximate a front of a drawer and a rear of a drawer, respectively.

Figure 4:
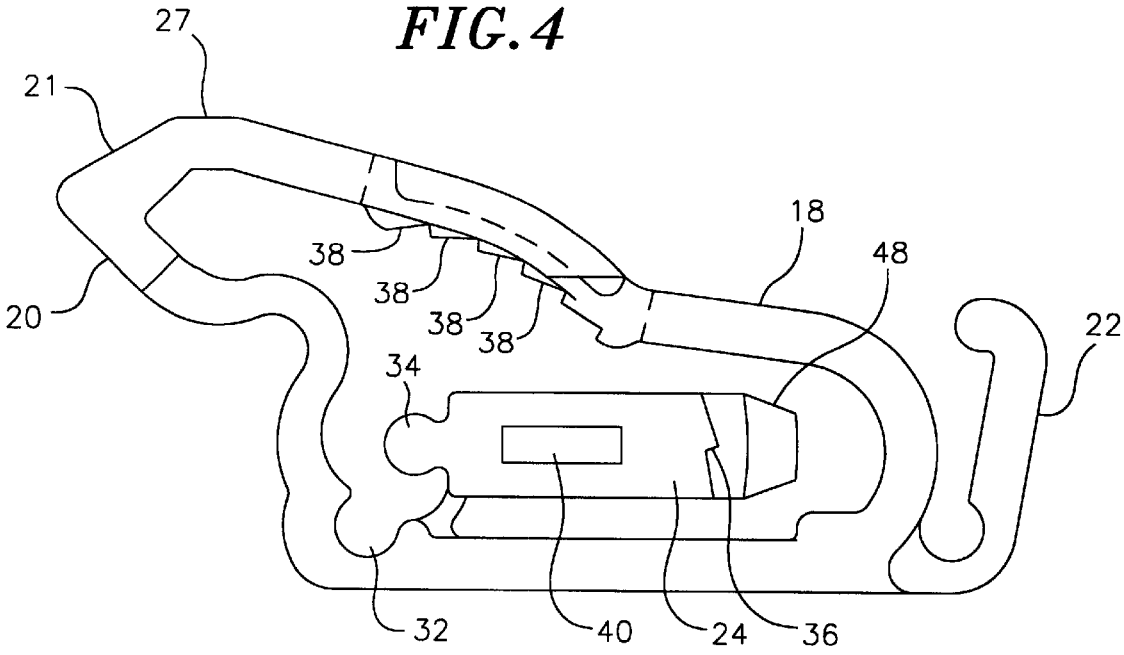
FIG. 4 is a side view of a detent mechanism in accordance with the present invention.

As may be seen more fully in FIG. 4, the detent mechanism comprises a body 18 of a generally elliptical shape having a head 20 at one end and a flex finger 22 extending from the elliptical shape at the opposite end. Preferably, the detent mechanism of the present invention is formed of a molded plastic.

The generally elliptical shape, or body, and head together comprise a closed band. The closed band includes a gradually sloping surface 19 extending from a midpoint of the length of the elliptical body toward a top 27 of the head. An opposite surface 21 extends away from the sloping surface 19 on the opposite side of the top of the head.

Figure 6:
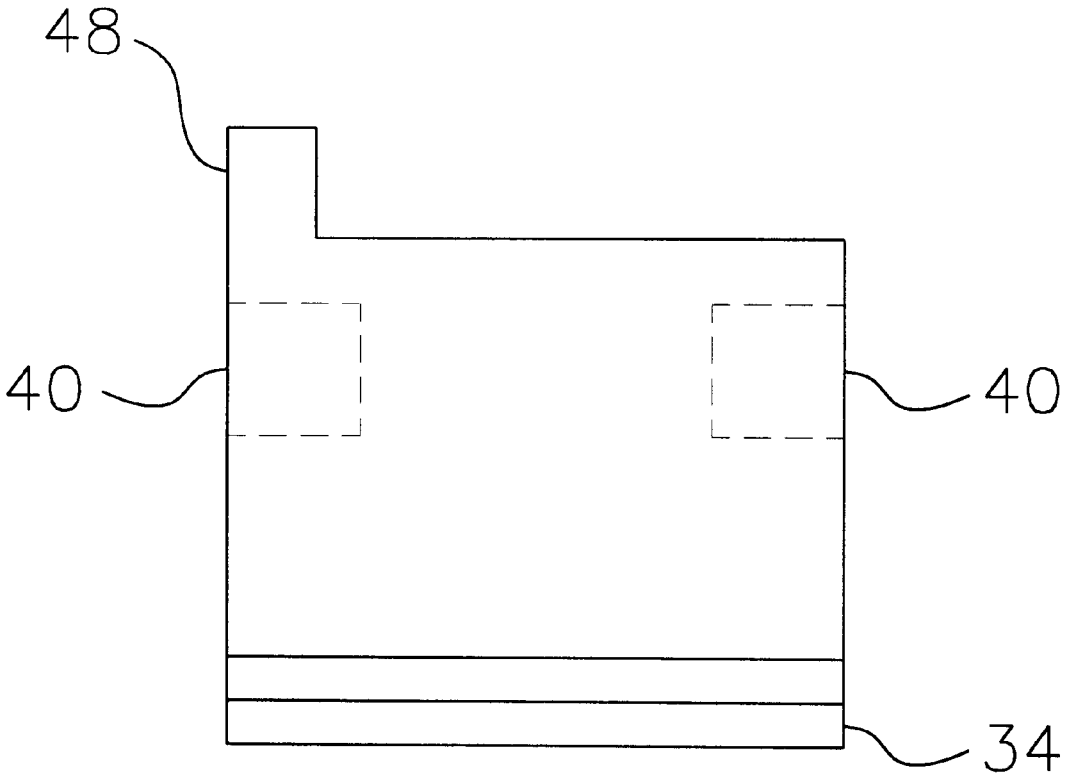
FIG. 6 is a front view of the detent mechanism of FIG. 5.

As shown in FIG. 4, an adjustable arm 24 of the present invention is formed such that it is connected by a bridge 42 and thereby held in position within the envelope defined by the mechanism 16. Forming the arm and the body in this manner provides for increased ease in assembly of the detent mechanism. Once the detent mechanism is ready for placement in a drawer slide, however, the bridge is ruptured. This allows a cylindrical head 34 at one end of the arm 24 to be placed in a socket 32 on the inside of the closed band formed by the body. Provided at the opposite of arm 24 is a shaped surface into which a tooth or indentation 36 is molded. Extending beyond the tooth 36, in the direction away from the cylindrical head 34, is a tapered surface 48. The tapered surface, its extension beyond the tooth, and its location along one side of the arm may be seen in FIG. 6. Also shown in FIG. 6 (in phantom), are slots 40 in the sides of the arm. The slots are adapted to receive a small screwdriver blade or the like to allow for increased ease of rotating the arm once the cylindrical head is placed in the socket of the body. The adjustable arm provides a means for adjusting the detent force produced by mechanism 16.

Figure 5:
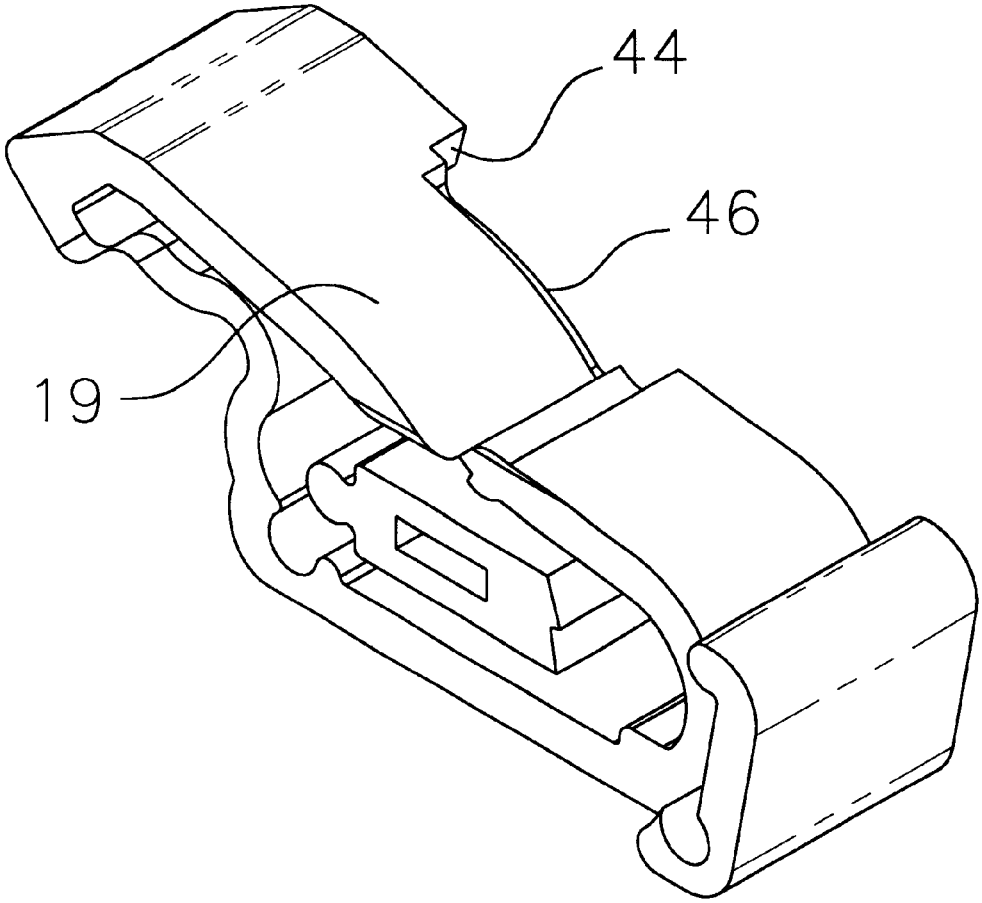
FIG. 5 is a perspective view of the detent mechanism of FIG. 4.

As may be seen in FIG. 5, as well as FIG. 3, the detent mechanism has a width such that the detent mechanism extends into, and slightly beyond, the web of the intermediate slide member when the detent mechanism is installed on the inner slide member. To avoid interference with motion of the intermediate slide member by the detent mechanism in one embodiment a cut-out 50 (shown in FIG. 1 )is made in the intermediate slide member. The intermediate member cut-out or relief 50, provides space sufficient for the inner slide member to telescopically be received within the intermediate member without interfering with the travel of the adjustable detent mechanism. In another embodiment, however, the longitudinal length of the intermediate slide member is such that a cut-out is not necessary as the portion of the intermediate slide which would be cut out is simply not there. The detent mechanism is therefore adapted to contact items extending from the outer slide member and towards the intermediate slide member, and the intermediate slide member is configured to allow the detent to contact items extending from the outer slide member.

Figure 2:
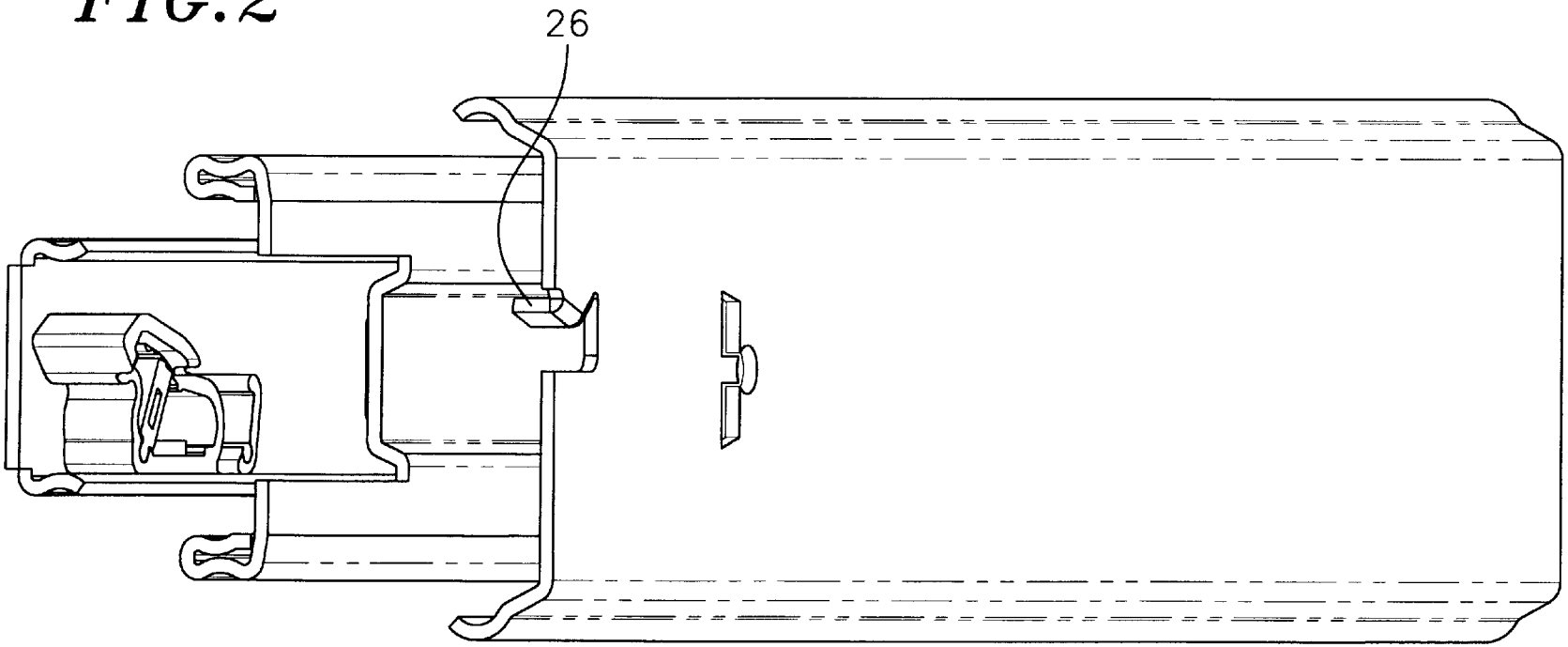
FIG. 2 is a perspective view of the slide of FIG. 1.

Accordingly, in the embodiment of FIGS. 1–3, a tab is formed on the web of the outer slide member, with the tab extending towards the intermediate slide member. As illustrated the tab is part of a formed member 26 is created by providing a cut-out or notch in the leading edge of the outer member 14 and bending and forming a tab extending from the web of slide member 14 toward the intermediate slide member 12. Thus, as seen in FIGS. 2 and 3, the formed up stop-end member is a shelf or tab extending interiorly of the outer slide member toward the intermediate slide member. The tabs extends into the path of the detent mechanism so as to engage surface 19 as the drawer is closed and surface 21 when the drawer is in the closed position and when a force is initially applied to the drawer to overcome the detent or holding force. As the tab contacts surface 21 or surface 19, the band forming the detent mechanism is compressed, or deforms or flexes, particularly the portion of the band formed by the head. The arm, however, resists compression of the band. As the position of the arm is adjustable within the band, the ease of compression of the band is also adjustable.

In operation, when the drawer slide is being closed and the members of the slide being telescoped within one another, surface 19 on the adjustable detent mechanism encounters stop member 26 and provides a low amount of resistance to closure of the drawer upon which the drawer slide is mounted. When fully closed, flex finger 22 encounters end-stop flange 28 to provide cushioning of the inner member as the drawer slide is closed and to reduce or eliminate the noise of the inner member coming to a complete stop within the drawer slide itself. When the slide is fully closed, surface 21, which is oppositely sloped from slope 19, along the head of the detent bears against the inner surface of stop member 26. The combination of flex finger 22 bearing against end-stop flange 28 and surface 21 bearing against formed stop end member 26 creates a locking effect to hold the drawer securely closed.

When the drawer is opened the adjustable detent mechanism and the position of adjustable arm 24 determine the amount of force that is required to pull the drawer slide out and open the drawer. Depending on the application, the drawer slide may be used in a tool box or it may be used in a cabinet or desk. When used in a tool box, a greater detent or holding force is desirable. When utilized in a drawer or cabinet a lower detent or holding force is desirable. By adjusting the flexible arm by means of a screw driver inserted in slot 40 of the adjustable arm and twisting the toothed edge of the adjustable arm toward head 20, the fulcrum point is moved toward the head shortening the fulcrum arm and increasing the detent or holding force. Conversely when the toothed surface of adjustable arm 24 is moved in the opposite direction toward flex finger 22, the fulcrum arm is lengthened and the amount of detent or holding force created by the adjustable mechanism is reduced.

Adjustment of the detent force provided by the mechanism is accomplished through positioning of the arm within the body. One end of the arm, the end with the cylindrical head, is securely maintained in the socket. The tooth at the other end is selectively engaged with one of the teeth 38 provided on the interior surface of the envelope adjacent the top of the adjustable detent mechanism. The use of teeth on the interior surface of the envelope is advantageous in that the position of the arm is adjustable in discrete increments, providing quantified step with adjustment of the detent mechanism. The detent force is determined by the positioning of the adjustable arm with respect to a specific tooth in the inner surface of the envelope. When the engagement is closer to flex finger 22, the fulcrum arm is lengthened and the detent force reduced. When the arm is engaged with a tooth closer to the head 20 of the detent mechanism, the fulcrum arm is shortened and the detent force increased. Typical ranges of detent or holding forces range from two to twelve pounds of force. The detent or holding force required can be thereafter adjusted by rotating arm 24 toward the flex finger or toward the head of the detent mechanism as desired by the user.

As may be viewed in FIG. 5, the sloped surface 19 of the detent mechanism has a cut-out 49 along one side. Tapered surface 48 bears against surface 46 located in cut-out 44 to retain the adjustable arm in place. This retention of the arm is accomplished by surface 48 bearing against surface 46 and by the inner surface or web of the inner slide member on the opposite side of arm 24. Thus, the cut-out serves as a guide in which travel of the tapered surface is restricted by placement of the detent mechanism against the web of the inner slide member.

Figure 7:
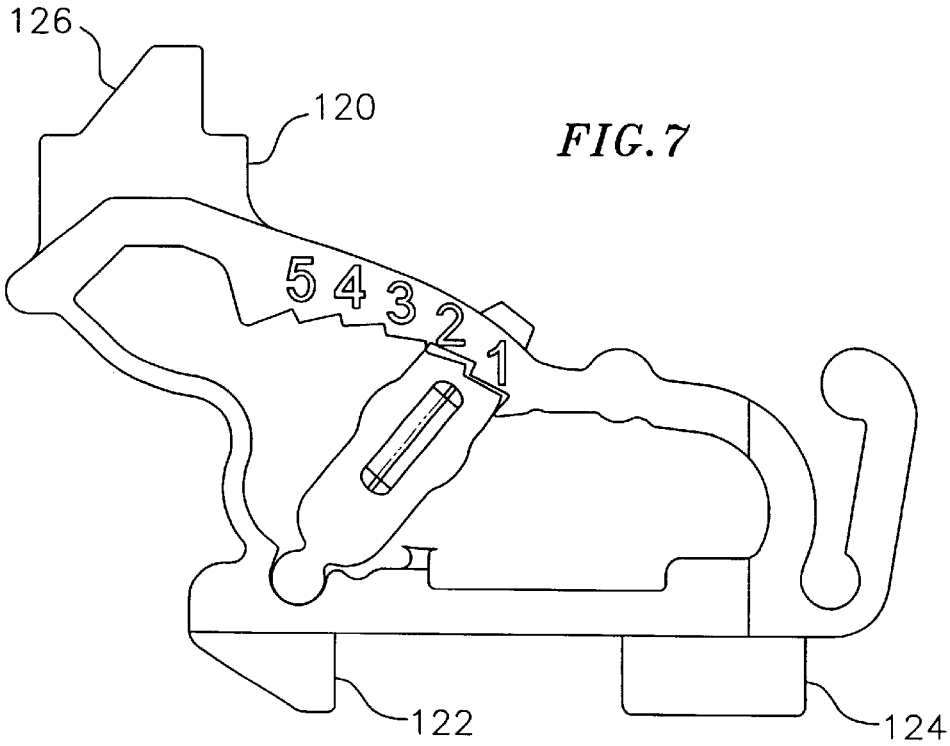
FIG. 7 is an alternative embodiment of a detent mechanism in accordance with the present invention.

The adjustable detent mechanism is mounted at the front of the slide and is maintained or held in position by bending the wall of the inner slide member over the edge of the detent mechanism and locking the detent mechanism in position against the web on the inner side of the inner slide member. In one embodiment and as can be seen in FIG. 7, the edge of the detent mechanism includes tab 120 extending from the head, and tabs 122 and 124 extending from the body. Tab 120 includes a rectangular base portion and an upper angled surface 126 extending from the rectangular base portion. Tab 120 similarly has an angled surface, with the angled surfaces increasing the ease of insertion and replacement of the detent mechanism. As may be seen in FIG. 8, the tabs extend along the same side of the body as on which the cut out 49 is located. Accordingly, the tabs extend from the detent such that the tabs are parallel to the web of the inner slide member, and are placed against the inner slide member. The tabs may be placed, therefore in bayonet pockets formed in the web of the inner slide member, for example.

Figure 9:
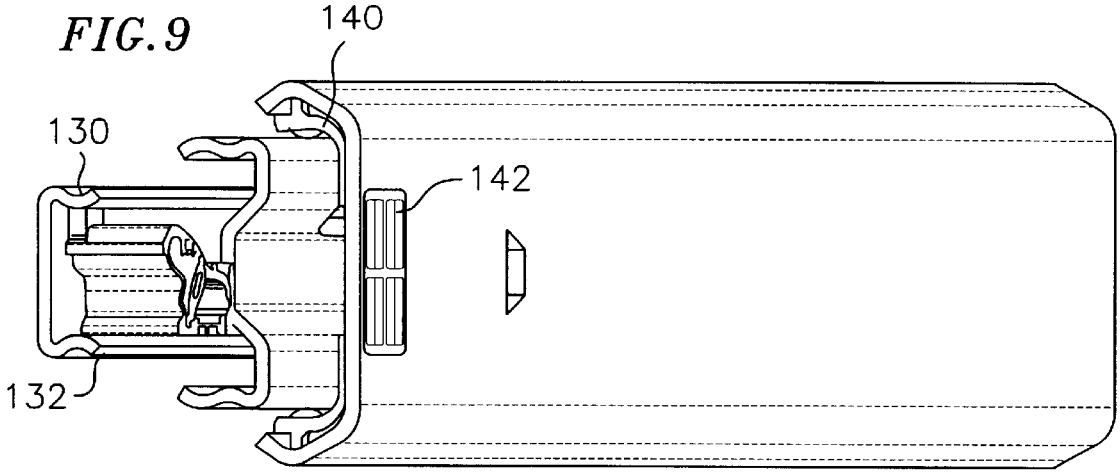
FIG. 9 is a perspective view of a drawer slide incorporating the detent mechanism of FIG. 7 and a guide block.

In another embodiment, however, and as illustrated in FIG. 9 the detent mechanism and tabs are dimensioned so that the tabs extend into the bearing raceways of the inner slide member. Cutouts 130 and 132 are formed in the inner slide member bearing raceways adapted to receive the tabs. Insertion of the tabs into the cut-outs securely holds the detent mechanism in place on the inner slide member.

Figure 8:
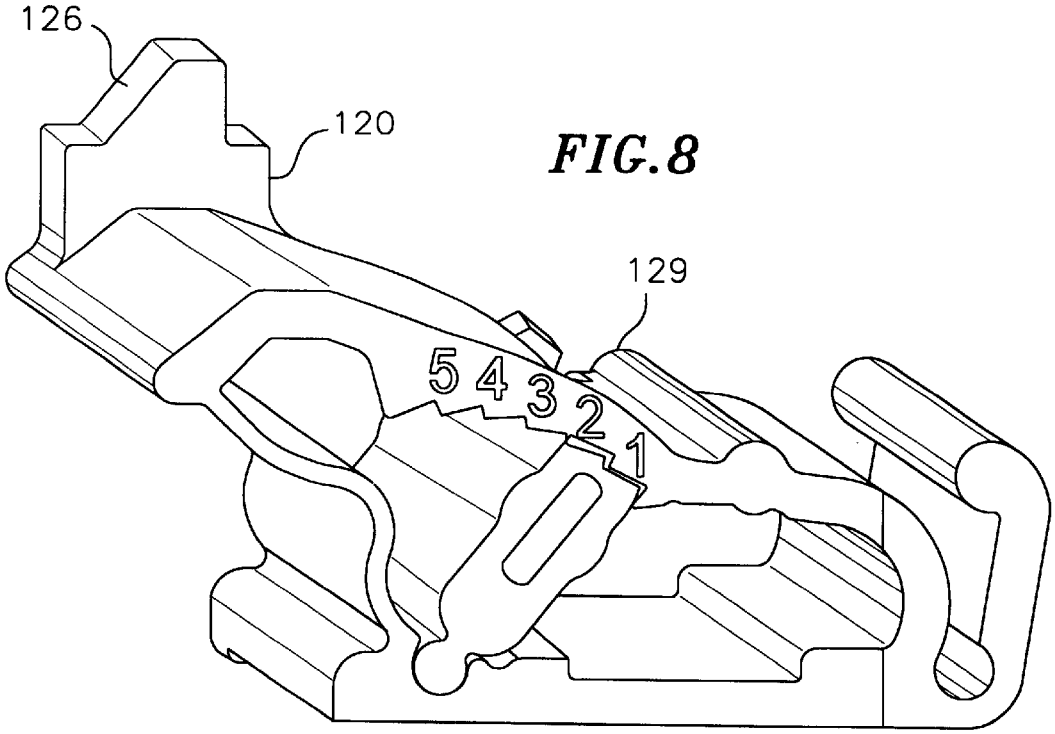
FIG. 8 is a perspective view of the detent mechanism of FIG. 7.

In addition, the detent mechanism of FIG. 8 includes a peg 129 extending from the elliptical body approximate the gradual sloping surface 19. The peg extends from the side of the detent mechanism on which the cut out 49 is located, and extends orthogonally from the tabs 120, 122, 124. The peg, therefore, extends into the web of the inner slide member when the detent mechanism is installed on the inner slide member. Accordingly, the web of the inner slide member is pierced with an aperture (not shown) adapted to receive and engage the peg.

Advantageously, the peg and aperture serve to reduce pivoting of the detent mechanism when the tab or strike post of the outer slide member is in contact with the detent mechanism. This is beneficial as such pivoting acts to modify an expected detent force, as well as to increase wear and the possibility of damage to the detent mechanism.

In an alternate embodiment the function of the tab of the stop-end member is performed by a guide block affixed to the outer slide member. The guide block is formed of plastic, and is inserted between the bearing raceways of the outer slide member. The guide block includes a tab, or strike post, which extends towards the intermediate slide member. The strike post contacts the detent mechanism as the drawer is shut. Advantageously, the use of a plastic strike post minimizes wear on the detent mechanisms.

FIG. 9 also illustrates an embodiment using such a guide block. As illustrated in FIG. 9, a plastic guide block 140 is coupled to the outer slide member. The guide block includes pegs 147 which extend through apertures in the web of the outer slide member. As may be more fully seen in FIG. 10, the guide block is comprised of two runners 144 *a, b* adapted for placement in the bearing raceways of the outer slide member. The runners include molded hemispheres 145 protruding away from the bearing raceways of the outer slide member. The hemispheres reduce the contact area between the guideblock and the intermediate slide member, thereby increasing the ease of removing the intermediate slide member from the outer slide member, while still providing support between the slide members when the slides are installed. A connector 142, similar in shape and concept to the webs of the slide members, connects the runners. Extending from the connector is a strike post 146. The strike post is towards a forward edge of the guide block, and is adapted to contact the detent mechanism.

Figure 10:
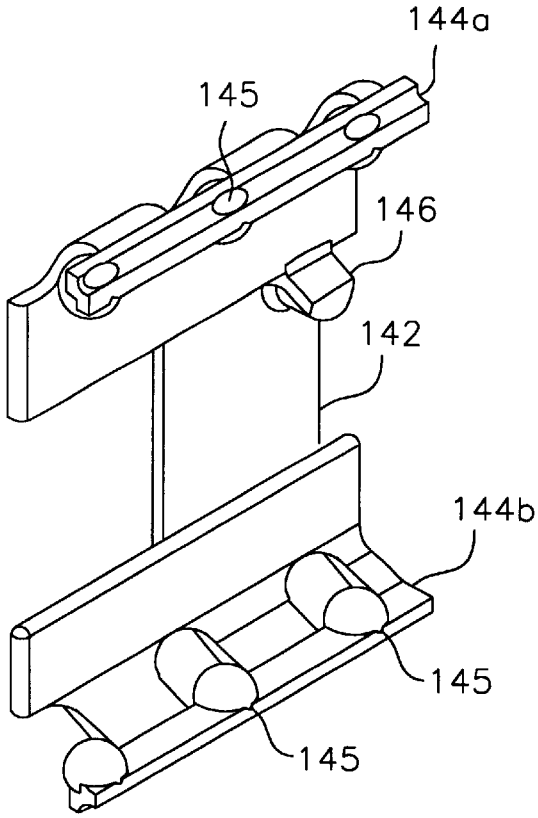
FIG. 10 is a perspective view of the guide block of FIG. 9.

In one embodiment, and as illustrated in FIGS. 9 and 10, the guide block is of a length such that the runners support the intermediate slide member when an intermediate slide member of shortened length is used. Support of the intermediate slide member provides for increased consistency in relative positioning of the slide members under varying loading of the slides, and therefore increased consistency in where the strike post contacts the detent mechanism.

In one embodiment of the invention, as shown in FIG. 1, there are five different teeth corresponding to five different positions for the adjustable arm and thereby obtain increased or decreased detent or holding force. Noise reduction is provided by the interaction of the flex finger 22 and the in-stop flange 28. Further advantages include the provision of a mechanism in which the adjustable arm 24 is molded as part of the adjustable detent mechanism which reduces possibility of separation of the arm and the body.

Although this invention has been described in certain specific embodiments, additional modifications and variations will be apparent to those skilled in the art. It is therefore to be understood that this invention may be practiced otherwise than is specifically described. Thus the present embodiments of the invention should be considered as illustrative and not restrictive. The scope of the invention is to be indicated by claims and their equivalents rather than limited to the foregoing description.

What is claimed is:

1. An adjustable detent mechanism for a telescoping drawer slide assembly having a plurality of telescoping members comprising:

a body defining a generally elliptical shapeable envelope mounted on one of the members;

an adjustable arm located within the envelope having an engaging surface located at one end thereof;

a plurality of mating elements located on the interior side of the envelope for being engaged by the engaging surface on the arm to select a detent or hold in force;

a detent surface on the exterior of the body; and a formed stop-in member on one of the other telescoping members for operatively engaging the detent surface whereby adjustment of the arm allows selection of the desired amount of detent or hold in force.

2. A telescopic drawer slide with an adjustable detent comprising:

a first drawer slide having a longitudinal length with a web and arcuate arms along longitudinal margins of the web;

a second drawer slide slidably coupled to the first drawer slide, the second drawer slide also having a longitudinal length with a web and arcuate arms along the longitudinal margins of the web, the second drawer slide being nested within the arcuate arms of the first drawer slide; and a detent mechanism coupled to the web of the second drawer slide, the detent mechanism having a body defining a band with an arm maintained in the band, the relative position of the arm with respect to the longitudinal length of the second drawer slide.

3. The telescopic drawer slide with an adjustable detent of claim 2 wherein the band includes a socket for receiving a first end of the arm.

4. The telescopic drawer slide with an adjustable detent of claim 3 wherein the band includes an engagement surface for contacting a second end of the arm.

5. The telescopic drawer slide with an adjustable detent of claim 4 wherein the engagement surface includes multiple portions for contacting the second end of the arm.

6. The telescopic drawer slide with an adjustable detent of claim 5 wherein the first slide member further comprises a tab extending from the web of the first slide member, the tab being adapted to contact the band of the detent mechanism.

7. The telescopic drawer slide with an adjustable detent of claim 6 wherein the tab is formed by bending a portion of the web of the first slide member.

8. The telescopic drawer slide with an adjustable detent of claim 6 wherein the tab extends from a guide block affixed to the first slide member.

9. The telescopic drawer slide with an adjustable detent of claim 6 wherein the band includes two opposingly sloped surfaces for contacting the tab.

10. The telescopic drawer slide with an adjustable detent of claim 9 wherein a first of the two opposingly sloped surfaces contacts the tab when the first and second drawer slides are in motion relative to one another in a first direction, and a second of the two opposingly sloped surfaces contacts the tab when the first and second drawer slides are in motion relative to one another in a second direction.

11. The telescopic drawer slide with an adjustable detent of claim 10 wherein the detent mechanism further comprises a flexing finger extending from the body.

12. The telescopic drawer slide with an adjustable detent of claim 11 wherein the first slide member further comprises a stop tab adapted to contact the flexing finger.

13. The telescopic drawer slide with an adjustable detent of claim 12 further comprising an intermediate slide member slidably coupled between the first slide member and the second slide member.

14. The telescopic drawer slide with an adjustable detent of claim 13 wherein the detent mechanism is coupled to a longitudinal end of the second drawer slide, and the intermediate slide member includes a cutout so that the intermediate slide member does not contact the detent mechanism.

* * * * *

UNITED STATES PATENT AND TRADEMARK OFFICE

CERTIFICATE OF CORRECTION

PATENT NO. : 6,497,464 B1
DATED : December 24, 2002
INVENTOR(S) : Robert J. Cammack et al.

It is certified that error appears in the above-identified patent and that said Letters Patent is hereby corrected as shown below:

Title page,
Item [73], Assignee, delete the comma "," after "International" to read -- Accuride International Inc. --

Signed and Sealed this

First Day of June, 2004

JON W. DUDAS
*Acting Director of the United States Patent and Trademark Office*